US007069598B1

(12) United States Patent
Welch

(10) Patent No.: US 7,069,598 B1
(45) Date of Patent: Jul. 4, 2006

(54) NECKED GARMENT HAVING BUILT-IN RECEPTACLE FOR AIR ACTIVATED HEATER

(76) Inventor: Brian Welch, 187 E. Liberty St., Berlin, WI (US) 54923

( * ) Notice: Subject to any disclaimer, the term of this patent is extended or adjusted under 35 U.S.C. 154(b) by 279 days.

(21) Appl. No.: 10/444,481

(22) Filed: May 23, 2003

Related U.S. Application Data

(60) Provisional application No. 60/384,248, filed on May 29, 2002.

(51) Int. Cl.
*A41B 3/00* (2006.01)

(52) U.S. Cl. ..... 2/129; 2/98

(58) Field of Classification Search ..... 2/468, 2/85, 90–92, 98, 102, 129, 116, 115, 207; 126/204; 219/211
See application file for complete search history.

(56) References Cited

U.S. PATENT DOCUMENTS 3,479,667 A * 11/1969 Mehl ..... 2/65
4,576,169 A * 3/1986 Williams ..... 607/109
4,603,440 A * 8/1986 Hale ..... 2/115
5,005,374 A 4/1991 Spitler ..... 62/259.3
5,088,549 A 2/1992 Schneider ..... 165/46
5,230,333 A * 7/1993 Yates et al. ..... 607/111
5,247,928 A 9/1993 Stilts, Jr. ..... 607/109
5,265,669 A 11/1993 Schneider ..... 165/46
5,302,806 A 4/1994 Simmons et al. ..... 219/211
5,375,261 A 12/1994 Lipke ..... 2/92
5,388,271 A * 2/1995 Sessoms ..... 2/115
5,484,448 A * 1/1996 Steele et al. ..... 607/108
5,605,144 A 2/1997 Simmons et al. ..... 126/204
6,038,701 A * 3/2000 Regan ..... 2/125
6,314,581 B1 * 11/2001 Bond ..... 2/129
6,412,116 B1 * 7/2002 Clark ..... 2/129
6,490,735 B1 * 12/2002 Rindle ..... 2/98
6,611,960 B1 * 9/2003 Kim ..... 2/129

* cited by examiner

*Primary Examiner*—Alissa L. Hoey
(74) *Attorney, Agent, or Firm*—Donald J. Ersler

(57) ABSTRACT

A necked garment having at least one receptacle for efficiently heating the neck of a wearer. The receptacle holds a heater packet. Heat from the heater packet transfers to the neck of the wearer wearing the garment. The receptacle and heater packet are preferably hidden from view, and are preferably situated to direct heat generated by the heater packet toward the neck of the wearer.

16 Claims, 3 Drawing Sheets

NECKED GARMENT HAVING BUILT-IN RECEPTACLE FOR AIR ACTIVATED HEATER

CROSS-REFERENCES TO RELATED APPLICATIONS

This is a utility patent application, taking priority from provisional patent application Ser. No. 60/384,248 filed on May 29, 2002.

BACKGROUND OF THE INVENTION

1. Field of the Invention

The present invention relates generally to garments and more particularly to indoor garments having enhanced ability to warm a wearer's neck.

2. Discussion of the Prior Art

Numerous garments have been developed to provide warmth over and above that which is available as body heat retained by elements of the garment itself. One known way to increase the warmth available from use of a garment is to incorporate a heating element into the garment. For example, commercially available air-activated heater packets may be inserted into a pocket in a garment. The heater packets generate heat that warm the wearer's body in the region near the heating packet.

A particularly important application of enhanced-warmth garments addresses adding heat at the wearer's neck. It is well known that the majority of the heat loss from a wearer's body is through the head. It is therefore very important that the head be kept warm during cold weather. By heating the blood passing through the neck on the way to the head, the head can be maintained at a warm temperature even in cold weather.

Another source of body heat loss concerns drafts. Even in indoor settings, a wearer sitting in a draft is susceptible to feeling cold. Such cold sensation is especially true for drafts, which blow over the wearer's head and neck. It is usually not desirable to wear outdoor clothing when indoors, merely to escape the cooling sensation produced by drafts.

Examples of prior garments used to warm the neck and having heater packets may be seen in U.S. Pat. Nos. 5,302,806 and 5,605,144. Both of these patents disclose a jacket having a collar. The collar has a heater pouch, which can hold an air activated heater packet. However, the heater pouch is positioned against an outer layer of the collar such that the collar must be turned up against the wearer's neck in order to gain optimum use of the heat being generated. By contrast, with the jacket collar in the normal down orientation, the heat must traverse at least two layers of the collar material to reach the wearer's neck as opposed to only one layer to reach ambient air. Accordingly, a large fraction of the heat generated in such heater pocket is lost to ambient air. In addition, if the collar is turned down, the heater packet is visible for all to see, thus reducing the aesthetic appeal of the garment. Further, although the illustrated jacket is eminently suitable for cold weather outdoor wear, such jacket is not normally worn indoors.

U.S. Pat. No. 5,375,261 discloses a dickey which encircles the neck. The dickey as illustrated is constructed of two layers of fabric. A receptacle pocket is defined in combination with at least one of the layers of fabric. An opening such as a slit or slot provides access to the receptacle near the back of the collar or over the chest of the wearer. A heater packet is inserted into the pocket. The free end of the collar is turned over one or more times to overlie the pocket and heater packet, or the access opening is hidden by an overlying article of clothing such as a sweater or shirt. Unless the collar is turned down, or the outer garment is worn over the dickie, the pocket with the heater packet is exposed to view. When the collar is turned over, or the outer garment is worn, the pocket and heater packet are hidden from view. However, because there are two layers of fabric between the heater packet and the wearer's neck, and only a single layer between the heater packet and ambient air, the effectiveness of the heater packet is diminished and a large fraction of the heat generated by the heater packet is lost to ambient air. Another disadvantage of the dickey of the U.S. Pat. No. 5,375,261 patent is that social custom dictates that another item of clothing be worn over the dickie, even indoors. In many instances, multiple garments are undesirable for wearing indoors.

U.S. Pat. Nos. 5,005,374; 5,088,549; 5,247,928; and 5,265,669 show separate neckbands with pockets for holding heating devices. None of the foregoing is particularly attractive for indoor wearing; and none couple a heating device with an article of clothing that encircles a wearer's torso. Thus, a need exists for improvements in garments for keeping the neck warm.

SUMMARY OF THE INVENTION

In accord with the present invention, a necked garment having a built-in heater receptacle and disposable heater packet is provided, wherein the heater and receptacle combination efficiently apply heat to the wearer's neck, wherein the heater and receptacle combination have little if any affect on the appearance of the garment to a casual observer, and wherein preferred such garments are suitable for wearing indoors. Such efficiency of heat distribution is accomplished by constructing the receptacle so as to have fewer layers of garment fabric between the heater packet and the wearer's skin then between the heater packet and ambient air.

According to one aspect of the invention, the receptacle is incorporated into a garment, which is generally similar to a conventional turtleneck sweater. The receptacle is defined between a surface layer of garment fabric adjacent the wearer's neck and a retaining flap of material sewn or otherwise joined to that surface, near the base of the collar of the turtleneck sweater, with the flap between the surface layer of the garment, and the wearer's neck. Access to the receptacle is through an open edge of the retaining flap which is not attached to the collar fabric. In that design, the only separation of the heater packet from the wearer's skin is the material of the retaining flap. Heat transfer from the heater packet to the skin is thus maximized consistent with safety from overheating of the skin. Further, the receptacle and the heater packet are hidden from view for all configurations of collar placement and for all locations of the receptacle and flap on the collar. Thus, if the collar is worn in a turned-down configuration, both the receptacle and the heater packet are hidden from view. Similarly, if the collar is worn in a turned-up configuration, against the chin and ears, both the receptacle and heater packet are hidden from view. A conventional heater packet is about 0.13 inch thick whereby the thickness of the heater packet, itself, is concealed by the combined thicknesses of the multiple layers of sweater and fabric at the collar of the sweater.

In a modified embodiment, the receptacle is defined between inner and outer layers of the collar of the sweater, adjacent the wearer's neck and near the base of the collar. Access to the receptacle is through a slit or slot or other opening in the layer of collar fabric which is disposed between an inner cavity of the receptacle and the neck of the wearer. The only separation of the heater packet from the skin is by the inner layer of the collar fabric. Heat transferred to the skin from the heater packet is maximized consistent with safety from overheating. When the collar is turned up, a relatively lower number of layers of collar fabric are between the heater packet and ambient air, whereby a relatively higher fraction of the heat generated by the heater; packet is lost to ambient air. When the collar is turned down in the traditional manner: of turtleneck sweaters, a relatively greater number of layers of the collar fabric are between the heater packet and ambient air, whereby a relatively lower fraction of the heat generated by the heater packet is lost to ambient air. In either case, the number of layers of sweater collar material between the heater packet and the wearer's skin is the same. Also, in either case, the entrance to the heater receptacle is hidden from view.

In a related embodiment, the access opening to the receptacle extends through fabric layers of the collar which are designed away from the wearer's neck. In such embodiment, the access opening is visible when the collar is worn in the "up" configuration, but is hidden from view when the collar is turned down.

The method and apparatus of the invention, using a receptacle and heater packet in an indoor garment, thus provides heat to a wearer's neck while generally not revealing to a casual observer the presence of either the receptacle or the heater packet. The garment can thus have conventional style and conventional aesthetic appeal, whereby the casual observer is unaware of the presence of the receptacle or the heater packet.

Other advantages, benefits, and features of the invention will become apparent to those skilled in the art in view of the disclosure contained herein.

Figure 1:
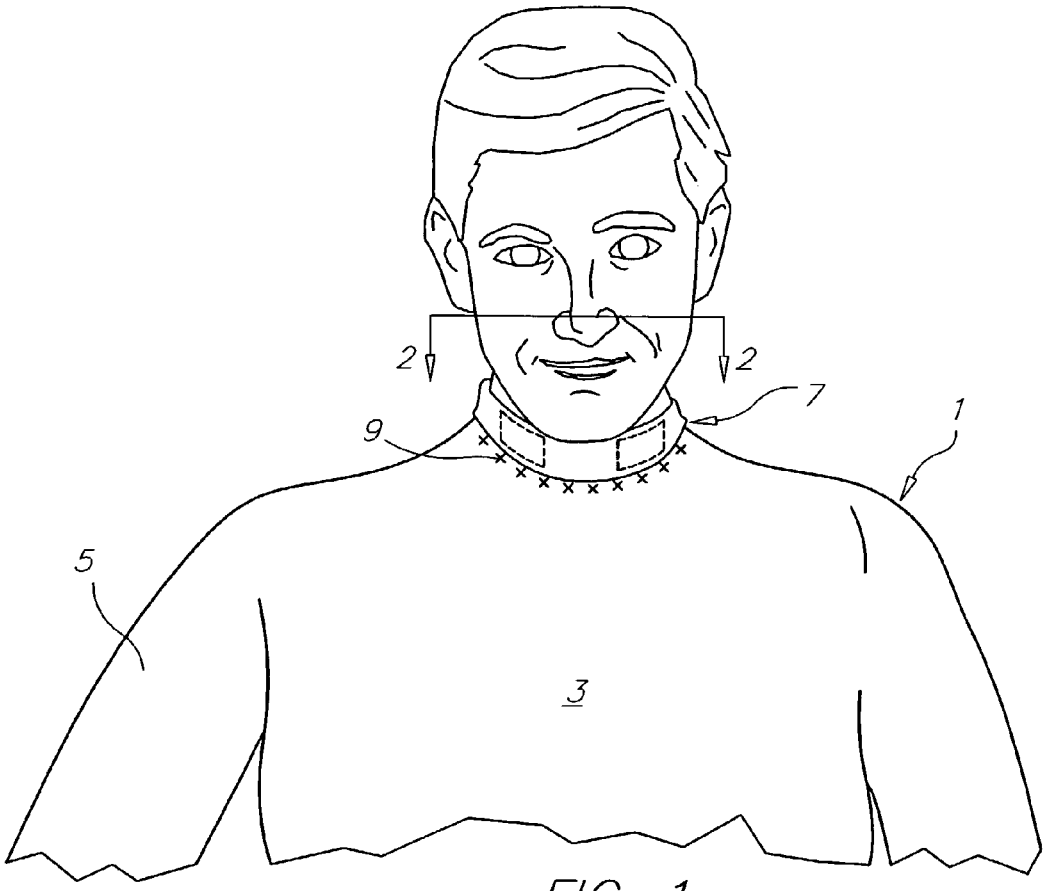
FIG. 1 is a front view of a person wearing a garment of the invention.

The invention is not limited in its application to the details of construction or the, arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DETAILED DESCRIPTION OF THE PREFERRED EMBODIMENTS

Although the disclosure hereof is detailed and exact to enable those skilled in the art to practice the invention, the physical embodiments herein disclosed merely exemplify the invention, which may be embodied in various other specific structures. Referring to FIGS. 1–4, a garment 1 embodying the invention is illustrated. The garment 1 illustrated represents garments generally known as turtleneck sweaters. The invention can as well be employed with other garments employing garment structure compatible with the principles taught herein.

Figure 4:
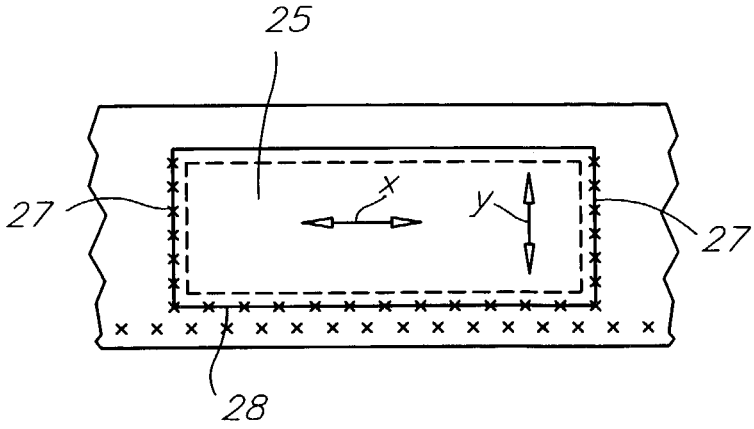
FIG. 4 is an inside view of the invention taken along line 4—4 of FIG. 3.

Garment 1 has a circumferential portion 3 which generally encircles the torso, of the wearer downwardly to a position at least between the wearer's shoulders, preferably downwardly to or beyond the wearer's waist. Garment 1 also has conventional sleeves 5 or other openings, joined with the circumferential portion 3, for receiving the wearer's arms. A collar 7 is joined, as by sewing, adhesive, or other bonding, along a joint 9, to the circumferential portion 3. In the particular turtleneck sweater illustrated in FIGS. 1–4, the collar 7 is made of a single piece of fabric 11, which is folded over along a fold line 13 to make side-by-side free ends 15. The fabric free ends 15 and the circumferential portions 3 are collectively joined to each other along the joint 9 at a neck opening 10 of the circumferential portion 3. In such joined configuration, the collar 7 has an inner layer 17 of fabric and an outer layer 19 of the fabric. In the configuration shown in FIG. 3, the collar is turned up such that the fold line 13 is close to the ears and chin of a wearer wearing the garment. In FIG. 4, the collar 7 is shown turned down in the traditional manner of wearing turtleneck sweaters such that fold line 13 is adjacent neck opening 10.

In accord with the present invention, at least one receptacle 21 is incorporated into the collar 7 of the garment 1. Any desired number of receptacles 21 can be employed about the circumference of collar 7, depending upon the size of a heater packet 29. Referring specifically to FIGS. 1–4, each receptacle 21 is defined by the inside surface 23 of the inner layer 17 of the collar fabric 11, which faces the wearer's neck, and by a receptacle flap 25 of material. The receptacle flap 25 can be made of the same material as layer 17. Alternative material for the receptacle flap 25 is preferably selected to have superior heat transfer properties for the transfer of heat from the heater packet 29. The alternative material of the receptacle flap 25 would have inferior heat insulating properties. The receptacle flap 25 is joined to layer 17 along a bottom 28 and two sides 27 of the receptacle flap 25 by sewing, adhesive, or other attachment method. The heater packet 29 can be placed in the receptacle 21 through an opening at the top of receptacle flap 25, whereat a top portion of the perimeter of receptacle flap 25 remains unbonded to layer 17. The unbonded portion of the flap may also be located along one of the two sides 27 (not shown) in which case, the top portion of the perimeter of receptacle flap 25 is jointed to layer 17.

The heater packet 29 is inserted into each receptacle 21. A suitable heater packet is marketed by Heat Factory, Inc., of Mission Viejo, Calif., under the name HEAT FACTORY. Typically, such heater packets contain dry particulate material which can react with oxygen in the air to produce heat of a temperature and at a rate, which is compatible with safely providing heat supplement to a wearer, when placed in close proximity to the wearer's skin, or through an adjacent layer of e.g. clothing. The heater packet 29 is activated by removing an outer barrier wrap, and is then placed in the receptacle 21 during a period when the garment is being worn. The chemicals in the heater packet 29 react with air and generate heat over a period of several hours. The heat is conducted and radiated to the wearer's neck, providing warmth to the wearer in cold conditions.

During such operation of the heating process, the outer surface of the garment gives little evidence to a casual observer regarding the presence of the heater or heater receptacle. Hence, collar 7 can be worn in the turned-up configuration of FIG. 3 or the turned-down configuration of FIG. 2, without impairing either the appearance or the function of the turtleneck sweater. In use, the heater packet 29 is separated from the wearer's neck by the single layer of the material of receptacle flap 25. On the other hand, the heater packet 29 is separated from the air surrounding the wearer by both layers 17 and 19 of the collar 7, when the collar is worn in the turned-up configuration of FIG. 3. As a result, layers 17 and 19 operate in a relative insulating mode whereby the majority of the heat produced by the heater packet is transferred through the receptacle flap 25 and thence presented to the skin of the wearer.

Figure 2:
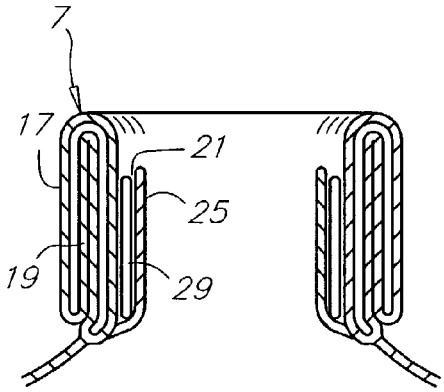
FIG. 2 is a cross-sectional view on an enlarged scale taken along line 2—2 of FIG. 1.
Figure 3:
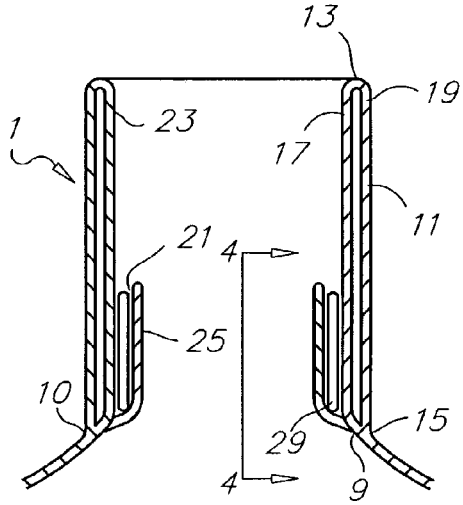
FIG. 3 is a view similar to FIG. 2, but showing the garment collar turned up as alongside a wearer's neck.

With reference to FIG. 2, the collar 7 can be worn in the turned-down configuration without exposing the receptacle 21 or the heater packet 29 to casual observation. In addition, layers 17 and 19 of collar fabric 11 are doubled between the heater packet and the surrounding air compared to the turned-up configuration of FIG. 3, whereby four layers (17, 19, 19, 17) are disposed between the heater packet 29 and ambient air, while only the flap 25 material is deposed between the heater packet 29 and the wearer's skin. Consequently, heat transfer from the heater packet 29 to the surrounding ambient air is minimized, and efficient heat transfer to the wearer's skin is optimized. At the same time, proper selection of material for flap 25, to suitably insulate the wearer from excess temperature, to distribute the heat laterally in "x" and "y" directions, as well as to ensure effective heat transfer, assures that the warmth generated by the heater packet 29 is efficiently transferred to the wearer without excessively heating the skin of the wearer.

Figure 5:
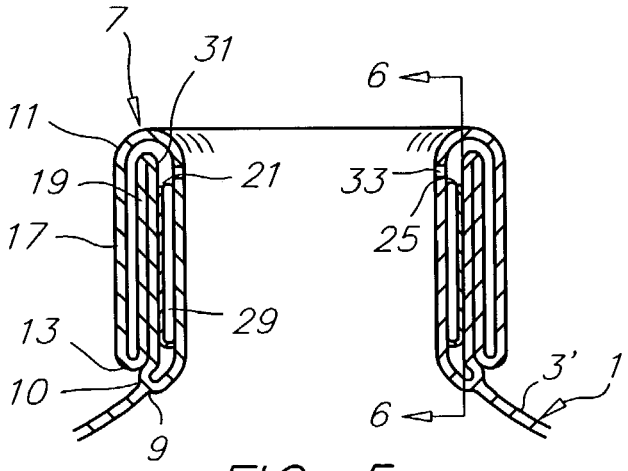
FIG. 5 is a view similar to FIG. 2 but showing a second embodiment, using two layers of the sweater collar material in forming the receptacle.
Figure 6:
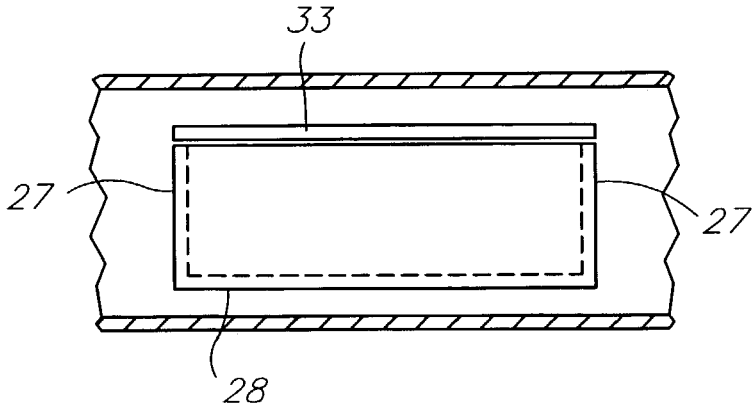
FIG. 6 is an inside view taken along line 6—6 FIG. 5.

Further in accord with the present invention, receptacles 21 can be disposed between layers 17 and 19 of the fabric of the collar 7. Turning to FIGS. 5 and 6, a garment 1 such as a turtleneck sweater has a torso enclosing circumferential portion 3' and a collar 7. The collar 7 is made of a piece of fabric 11 folded along a fold line 13 so as to create an inner layer 17 and an outer layer 19 of the fabric. The free ends 15 of fabric 11 and the circumferential portion 3' collectively are jointed to each other along joint line 9 around neck opening 10 of circumferential portion 3'. Each receptacle 21 is on the opposite side of inner layer 17 from the wearer's skin. Specifically, the flap 25 can be joined along its bottom 28 and sides 27 to the outwardly deposed surface 31 of inner layer 17 so as to fabricate a receptacle 21 between flap 25 and layer 17. Consequently, the receptacle 21 is upwardly open at a top edge of the flap 25.

In another family of embodiments, the flap 25 can be joined to layer 17 proximate top and bottom edges of the flap 25 and proximate a single side, there by to leave an opening into the receptacle 21 at the opposing side.

In yet another family of embodiments, the flap 25 can be similarly bonded to the layer 19 of the collar 7 so as to form the receptacle 21 between the flap 25 and the layer 19. Yet further, the flap 25 can be omitted entirely and the receptacle 21 can be formed by directly joining fabric collar layers 17 and 19 to each other at e.g. the sides and bottom of the receptacle 21 being formed, or at the top, bottom, and one side of the receptacle 21 being formed, thus to create either a top-open receptacle or a side-open receptacle, respectively, between layers 17 and 19; inner surfaces of such receptacles are defined by respective surfaces of layers 17 and 19.

Whether with or without use of the flap 25, when receptacles 21 are disposed between layers 17 and 19, access to the receptacle 21 is through either layer 17 or layer 19. Access through layer 17 is preferred, whereby an access opening 33 is hidden from view of the casual observer in all collar configurations.

In the alternative, access can be had through layer 19. But in such case, the access is hidden from view only when the collar, namely fold line 13, is turned down as in FIGS. 2 and 5. By contrast, if/when the collar is extended upwardly as in FIG. 3, such access opening in layer 19 is visible.

As above, the joinder of the fabric layers at the three sides of a given receptacle can be effected by a wide variety of known joinder mechanisms, such as sewing, adhesive bonding, various mechanical fasteners such as snaps, buttons, hook and loop fasteners, and the like.

Selection of material for each of layers 17, 19, and 25 depends on the structure and location related for the receptacle, the number of layers desired between the heater packet and the wearer's neck, and the number of layers deposed outwardly of the heater packet, namely between the heater packet and the ambient environment. Given such structural information, those skilled in the art can select suitable material for the respective layers so as to effectively apply the heat generated, to the need of the wearer. Thus, the thermal insulation properties, conversely thermal conductivity, of the first and second layers can differ from each other in one embodiment of the garment. In another embodiment, the thermal insulation properties of the first and second layers are the same and preferably superior to the material from which the receptacle flap 25 is fabricated to prevent heat from escaping an outer perimeter of the collar 7.

Whichever receptacle configuration is used, the receptacle is large enough to receive a heater packet 29 suitably sized and configured to provide the intensity and duration of heat typically desired. A typical heater packet can be e.g. about 2.25 inches by about 3.5 inches by about 0.13 inch. Of course, a wide variety of sizes of heater packets can be employed, longer or shorter, narrower or wider, than the illustrated size, so long as heat intensity and duration correspond with the anticipated need of a typical wearer, and so long as the configuration of the heater packet is compatible with the configuration of the receptacle pocket.

To gain access to the receptacle, a slit, slot, or other access opening 33 is formed in one of the layers 17 or 19 to gain access to any receptacles 21 between layers 17, 19. Such access opening 33 is long enough to enable heater packet 29 to pass through for insertion into the corresponding receptacle.

Figure 7:
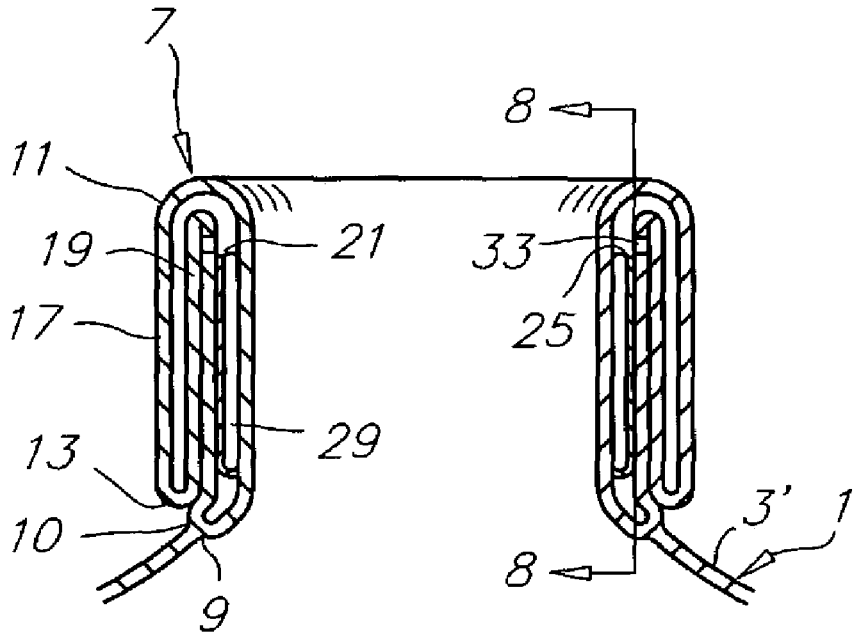
FIG. 7 is a view similar to FIG. 5, but showing a third embodiment of the invention, wherein the entrance to the receptacle extends through an outwardly disposed layer of the collar fabric of the sweater.
Figure 8:
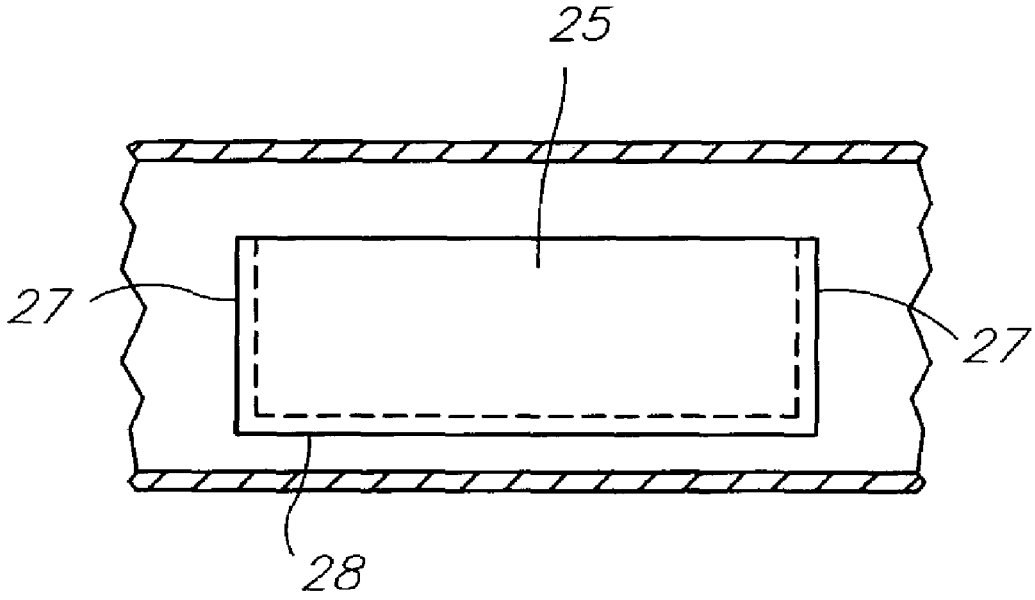
FIG. 8 is an inside view taken along line 8—8 of FIG. 7.

As shown in FIG. 7, the collar 7 is typically worn in the turned-down configuration. In that situation, the access opening 33 is hidden from view in all embodiments, as is heater packet 29. If the wearer desires to wear the collar in the turned-up configuration as in FIG. 3, the only visible evidence of the presence of the heater packet is where opening 33 extends through layer 19, and even there, the suggestion is limited to e.g. the presence of a slit at access opening 33. Accordingly, even wearing the collar in the turned-up configuration need not be greatly revealing of the heater packet or receptacle. Indeed, where the access opening 33 extends through layer 17, the only outward evidence of the heater packet is the slight increase (e.g. 0.13 inch) in thickness of the collar 7 at those receptacles, which are then housing heater packets 29. However, given the typical thickness of a turned-down collar of a e.g. turtleneck sweater, at about 0.5 inch, and given the irregular nature of the appearance of such collars, presence of such heater packet 29 in hidden receptacles 21, is not readily noticeable by a casual observer.

A major advantage of especially preferred garments of the invention is that such garments are generally indoor wear garments. Such garments thus are suitable for wearing without also requiring any outerwear garment. On the other hand, if a wearer does wear a garment of the invention outdoors in cooler weather, with such heater in place and in operation, such garment can be worn with a desired perceived degree of warmth, and with no coat or jacket, at ambient temperatures cooler than if no heaters were being used. Further, if a wearer wears the garment outdoors under a coat or jacket, any collar of the coat or jacket further insulates the heater packet 29 from the ambient environment, thus to further enhance the efficiency of activated heater packets 29 in heating the wearer's neck.

Accordingly, the benefits and advantages of typically indoor garments such as turtleneck sweaters can now be more fully realized by employing the invention to enhance the range of temperatures in which such garments can be comfortably used, whether with or without use of additional overlying garments. Particularly garments of the invention are typically placed adjacent, next to, in surface-to-surface relation to, the wearer's skin, or are displaced from the wearer's skin by no more than one garment; thus to effectively employ the heat generated by conventional air-activated heat packets.

It will also be recognized that in addition to the superior performance of the garment of the invention, its construction is such as to cost little, if any, more than traditional turtleneck sweaters and similar garments. In fact, such increase in cost, if any, is negligible compared to the comfort and associated health related benefits provided by garments of the invention.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

I claim:

1. A method of forming a garment with a heated collar, comprising the steps of:

providing a circumferential portion that encircles a torso of a wearer, said circumferential portion having a neck opening and opposing arm openings;

providing a collar having a first layer and a second layer, securing an end of said first layer to an end of said second layer and said neck opening, one side of said first layer being adjacent a neck of a wearer;

securing at least one flap to the other side of said first layer, forming an access opening through said first layer adjacent each one of said at least one flap; and inserting a heater packet in each one of said at least one flap.

2. The method of forming a garment with a heated collar of claim 1, further comprising the step of:

folding an excess portion of said first and second layers over themselves.

3. The method of forming a garment with a heated collar of claim 1, further comprising the step of:

providing a turtle neck collar for said collar.

4. The method of forming a garment with a heated collar of claim 1, further comprising the step of:

providing said at least one flap fabricated from a material having superior heat transfer properties to facilitate heat transfer from said heater packet.

5. The method of forming a garment with a heated collar of claim 1, further comprising the step of:

providing an air-activated heater packet for said heater packet.

6. The method of forming a garment with a heated collar of claim 1, further comprising the step of:

said first layer and said second layer having superior thermal insulation properties to prevent heat from escaping an outer perimeter of said collar.

7. A method of forming a garment with a heated collar, comprising the steps of:

providing a circumferential portion that encircles a torso of a wearer, said circumferential portion having a neck opening and opposing arm openings;

providing a collar having a first layer and a second layer, securing an end of said first layer to an end of said second layer and said neck opening, one side of said first layer being adjacent a neck of a wearer;

securing at least one flap to the other side of said first layer, forming at least one access opening through said first layer;

inserting a heater packet into each one of said at least one access opening; and folding an excess portion of said first and second layers over themselves.

8. The method of forming a garment with a heated collar of claim 7, further comprising the step of:

attaching a flap to the other side of said first layer below each one of said at least one access opening, said flap being disposed between said first layer and said second layer.

9. The method of forming a garment with a heated collar of claim 7, further comprising the step of:

providing a turtle neck collar for said collar.

10. The method of forming a garment with a heated collar of claim 7, further comprising the step of:

providing an air-activated heater packet for said heater packet.

11. The method of forming a garment with a heated collar of claim 7, further comprising the step of:

said second layer having superior thermal insulation properties to said first layer, said first layer having superior heat transfer properties to said second layer.

12. A method of forming a garment with a heated collar, comprising the steps of:

providing a circumferential portion that encircles a torso of a wearer, said circumferential portion having a neck opening and opposing arm openings;

providing a collar including a first layer and a second layer, securing an end of said first layer to an end of said second layer and said neck opening, one side of said first layer being adjacent a neck of a wearer;

securing at least one flap to the other side of said first layer, forming an at least two access openings through said first layer; and inserting a first heater packet into a first one of said at least two access openings, inserting a second heater packet into a second one of said at least two access openings.

13. The method of forming a garment with a heated collar of claim 12, further comprising the step of:

attaching a first flap to the other side of said first layer below said first one of said at least two access openings, attaching a second flap to the other side of said first layer below said second one of said at least two access openings, said first flap and said second flap being disposed between said first layer and said second layer.

14. The method of forming a garment with a heated collar of claim 13, further comprising the step of:

folding an excess portion of said first and second layers over themselves.

15. The method of forming a garment with a heated collar of claim 12, further comprising the step of:

providing an air-activated heater packet for said heater packet.

16. The method of forming a garment with a heated collar of claim 12, further comprising the step of:

said second layer having superior thermal insulation properties to said first layer, said first layer having superior heat transfer properties to said second layer.

* * * * *